US009528400B2

(12) United States Patent
Nemoto et al.

(10) Patent No.: US 9,528,400 B2
(45) Date of Patent: Dec. 27, 2016

(54) VALVE TIMING CONTROL APPARATUS

(71) Applicant: DENSO CORPORATION, Kariya, Aichi-pref. (JP)

(72) Inventors: Kazuaki Nemoto, Okazaki (JP); Tadao Ikihara, Okazaki (JP)

(73) Assignee: DENSO CORPORATION, Kariya (JP)

( * ) Notice: Subject to any disclaimer, the term of this patent is extended or adjusted under 35 U.S.C. 154(b) by 153 days.

(21) Appl. No.: 14/457,241

(22) Filed: Aug. 12, 2014

(65) Prior Publication Data

US 2015/0053156 A1 Feb. 26, 2015

(30) Foreign Application Priority Data

Aug. 22, 2013 (JP) ..... 2013-172045
Apr. 22, 2014 (JP) ..... 2014-88057

(51) Int. Cl.
*F01L 1/34* (2006.01)
*F01L 1/344* (2006.01)

(52) U.S. Cl.
CPC .... *F01L 1/3442* (2013.01); *F01L 2001/34479* (2013.01)

(58) Field of Classification Search
CPC ..... F01L 1/3442; F01L 2001/34479
USPC ..... 123/90.15, 90.17
See application file for complete search history.

(56) References Cited

U.S. PATENT DOCUMENTS 5,875,750 A * 3/1999 Iwasaki ..... F01L 1/3442 123/90.17
7,556,000 B2 * 7/2009 Pierik ..... F01L 1/022 123/90.15
2006/0048731 A1 3/2006 Ikihara et al.
2006/0137635 A1 * 6/2006 Hayashi ..... F01L 1/022 123/90.17
2011/0000447 A1 * 1/2011 Hoppe ..... F01L 1/3442 123/90.15
2011/0094464 A1 * 4/2011 Eimert ..... F01L 1/3442 123/90.15

FOREIGN PATENT DOCUMENTS

JP 2000-170512 6/2000
JP 2003-113702 4/2003
JP 2007-182835 7/2007
JP 2011-144778 7/2011

OTHER PUBLICATIONS

Office Action (3 pages) dated Jul. 9, 2015 issued in corresponding Japanese Application No. 2014-088057 and English translation (4 pages).

* cited by examiner

*Primary Examiner* — Ching Chang
(74) *Attorney, Agent, or Firm* — Nixon & Vanderhye P.C.

(57) ABSTRACT

A valve timing control apparatus includes: a rear plate; a housing fixed to the rear plate; and a vane rotor which is able to rotate relative to the housing. The vane rotor includes a rotor and a vane extending from the rotor outward in a radial direction to divide an oil pressure chamber of the housing into an advance chamber and a retard chamber. The vane has an axial end surface adjacent to the rear plate and a radially outer surface. A first chamfer part is defined at a connection between the axial end surface and the radially outer surface of the vane so as to reduce a surface pressure applied from the rear plate to the vane.

11 Claims, 11 Drawing Sheets

VALVE TIMING CONTROL APPARATUS

CROSS REFERENCE TO RELATED APPLICATION

This application is based on Japanese Patent Application No 2013-172045 filed on Aug. 22, 2013, and Japanese Patent Application No. 2014-88057 filed on Apr. 22, 2014, the disclosures of which are incorporated herein by reference in their entirety.

TECHNICAL FIELD

The present disclosure relates to a valve timing control apparatus.

BACKGROUND

JP 2003-113702A describes a valve timing control apparatus in which a driving force of a crankshaft (a driving shaft) is transmitted through a drive belt, so the valve timing control apparatus is configured such that oil in an oil pressure chamber defined inside a housing is restricted from leaking to outside of the internal combustion engine. The housing has a central hole, and a center bolt is tightened to a camshaft (a driven shaft) through the central hole, and a cap is mounted to the central hole for preventing the oil leak from the oil pressure chamber. Moreover, an O-ring is placed between the housing and a rear plate to prevent the oil leak from the oil pressure chamber. The center bolt is used for fixing a vane rotor, a bushing fitted to a recess portion defined in the vane rotor, and the camshaft with each other.

SUMMARY

It is an object of the present disclosure to provide a valve timing control apparatus, a reliability of the valve timing control apparatus being raised in the operation.

A valve timing control apparatus has a vane rotor in an oil pressure chamber between a rear plate and a housing. A first chamfer part is defined at a connection between the axial end surface of the vane and the radially outer surface of the vane.

Accordingly, when a load is applied to the vane rotor from the rear plate, the contact pressure applied to the radially outer side of the axial end surface of the vane is reduced. Therefore, the axial end surface of the vane rotor adjacent to the rear plate is restricted from being damaged. Thus, the reliability of the valve timing control apparatus can be improved in the operation.

A second chamfer part is defined at a connection between the axial end surface of the rotor and the radially outer surface of the rotor.

Accordingly, when a load is added to the vane rotor from the rear plate, the contact pressure applied to the radially outer side of the axial end surface of the rotor can be reduced, and the axial end surface is restricted from being damaged.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
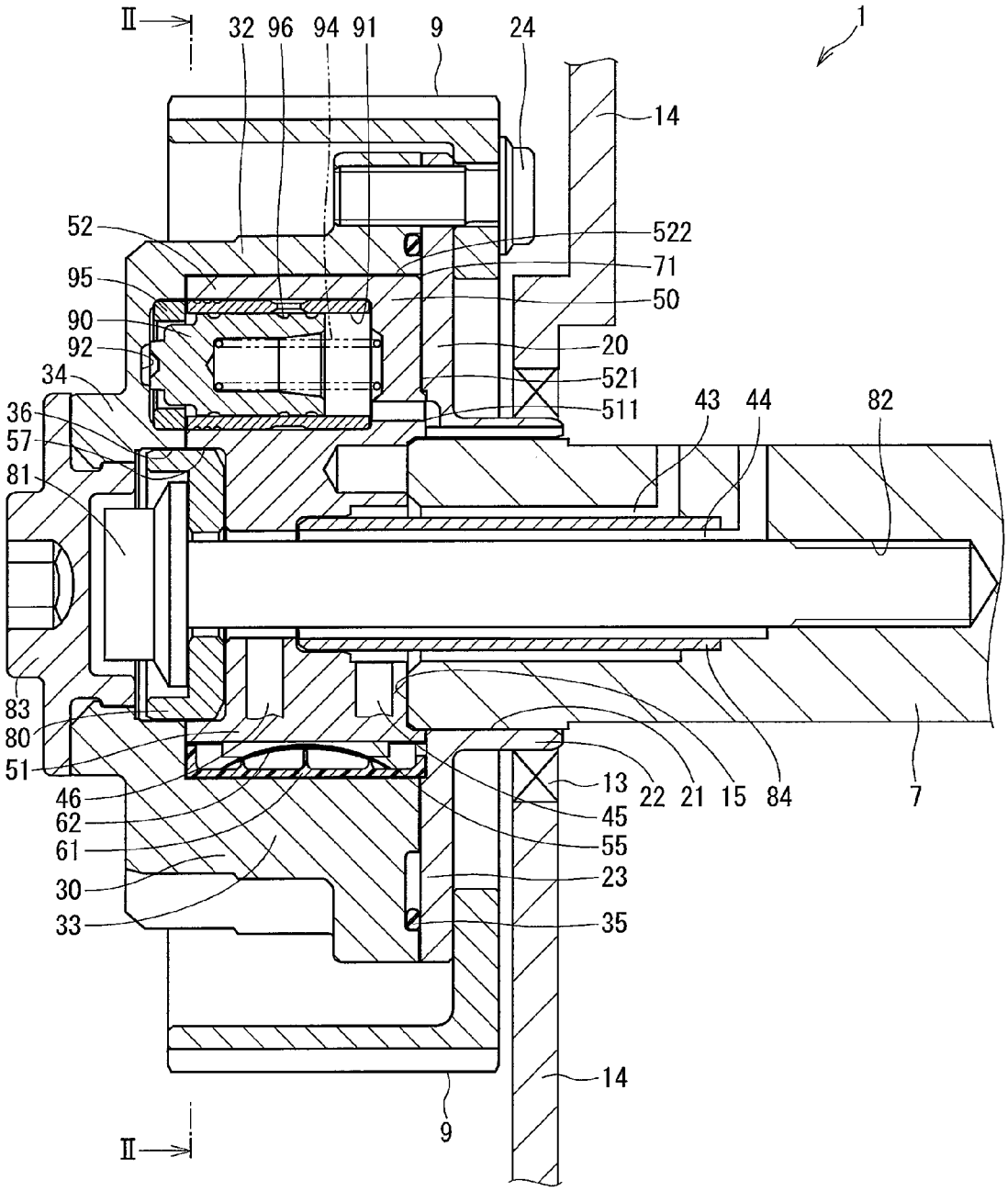
FIG. 1 is a sectional view illustrating a valve timing control apparatus according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

A first embodiment is described with reference to FIGS. 1-9. A valve timing control apparatus 1 is used in a power train mechanism for an internal combustion engine 2 shown in FIG. 3. A belt 10 is wound around a pulley 4 fixed to a crankshaft 3 (driving shaft) of the engine 2, a pulley 8 fixed to a camshaft 6 (driven shaft) of the engine 2, and a pulley 9 fixed to a camshaft 7 (driven shaft) of the engine 2. A torque is transmitted to the camshaft 6, 7 from the crankshaft 3. The camshaft 6 drives an exhaust valve 11, and the camshaft 7 drives an intake valve 12. The pulley 9 is connected to the belt 10, and a vane rotor 50 is connected to the camshaft 7. The opening-and-closing timing of the intake valve 12 is adjusted by the valve timing control apparatus 1 by rotating the crankshaft 3 and the camshaft 7 with a predetermined phase difference. The valve timing control apparatus 1 rotates clockwise in FIG. 3.

Figure 2:
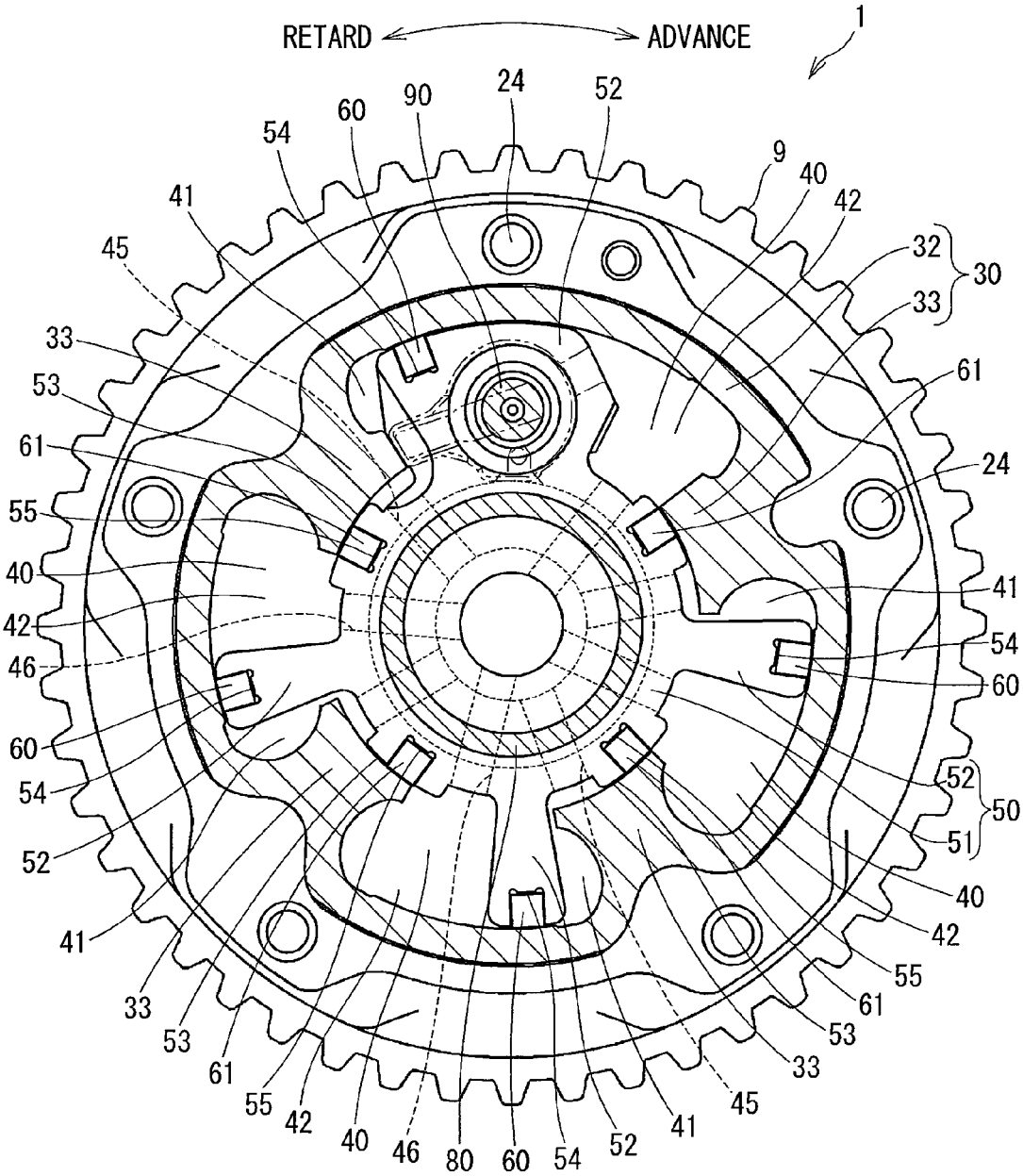
FIG. 2 a cross-sectional view taken along a line II-II of FIG. 1.

As shown in FIG. 1 and FIG. 2, the valve timing control apparatus 1 includes a rear plate 20, the pulley 9, a housing 30, the vane rotor 50, a first seal component 60, a second seal component 61, a first chamfer part 71, a second chamber part 72, a bushing 80, a center bolt 81, and a cap 83.

The rear plate 20 has a pipe part 22 and a disk part 23. The pipe part 22 has a hole 21, and the camshaft 7 is able to pass through the hole 21. The disk part 23 extends outward in the radial direction from the axial end of the pipe part 22. The camshaft 7 is slidingly in contact with the inner wall of the hole 21 of the pipe part 22. The outer wall of the pipe part 22 is attached to an engine cover 14 through an annular oil seal 13.

The pulley 9 and the housing 30 are fixed to the radially outer side of the disk part 23 by a bolt 24. The belt 10 is wound around the pulley 9. For this reason, the driving force of the crankshaft 3 is transmitted through the belt 10 to rotate the pulley 9, the rear plate 20, and the housing 30.

The housing 30 is fixed to the disk part 23 of the rear plate 20. The housing 30 is located opposite from the camshaft 7 through the rear plate 20 in a thickness direction of the rear plate 20.

The housing 30 has a peripheral wall 32 having a cylindrical shape, plural shoes 33 and a front plate 34. The shoe 33 extends from the peripheral wall 32 inward in the radial direction. The front plate 34 is located opposite from the rear plate 20 through the peripheral wall 32. The plural shoes 33 are arranged in a rotational direction with a predetermined interval. An oil pressure chamber 40 is defined between the shoes 33 adjacent with each other in the rotational direction.

An O-ring 35 is disposed between the housing 30 and the rear plate 20 to prevent oil leak from the oil pressure chamber 40. Thereby, oil is restricted from leaking from the oil pressure chamber 40 to the outside of the housing 30.

The vane rotor 50 includes a rotor 51 having a cylindrical shape, and plural vanes 52. The rotor 51 is coaxially arranged with the camshaft 7. The vane 52 extends from the rotor 51 outward in the radial direction. The vane rotor 50 is accommodated between the rear plate 20 and the housing 30. The vane rotor 50 is rotatable relative to the rear plate 20 and the housing 30. The vane rotor 50 is made of, for example, aluminum.

The rotor 51 has an axial end surface 511 adjacent to the rear plate 20, and the vane 52 has an axial end surface 521 adjacent to the rear plate 20. The axial end surface 511 of the rotor 51 is projected toward the camshaft 7 in an axial direction as the axial end surface 521 of the vane 52.

The rotor 51 has a projection part 53 projected outward in the radial direction, and a radially outer surface 512 of the projection part 53 of the rotor 51 slidingly contacts the shoe 33. The vane 52 has a radially outer surface 522 which slidingly contacts the peripheral wall 32. Thereby, the vane rotor 50 divides the oil pressure chamber 40 of the housing 30 into an advance chamber 41 and a retard chamber 42.

The radially outer surface 522 of the vane 52 has a recess portion 54 extending in the axial direction. The radially outer surface 512 of the projection part 53 of the rotor 51 has a recess portion 55 extending in the axial direction. The first seal component 60 is disposed in the recess portion 54 of the vane 52. The second seal component 61 is disposed in the recess portion 55 of the rotor 51.

The first seal component 60 in the recess portion 54 of the vane 52 is pressurized outward in the radial direction by a spring (not shown), and is liquid-tightly in contact with the peripheral wall 32 of the housing 30. The second seal component 61 in the recess portion 55 of the rotor 51 is pressurized outward in the radial direction by a spring 62, and is liquid-tightly in contact with the shoe 33 of the housing 30. Thereby, the seal component 60, 61 restricts oil from moving between the advance chamber 41 and the retard chamber 42.

Figure 4:
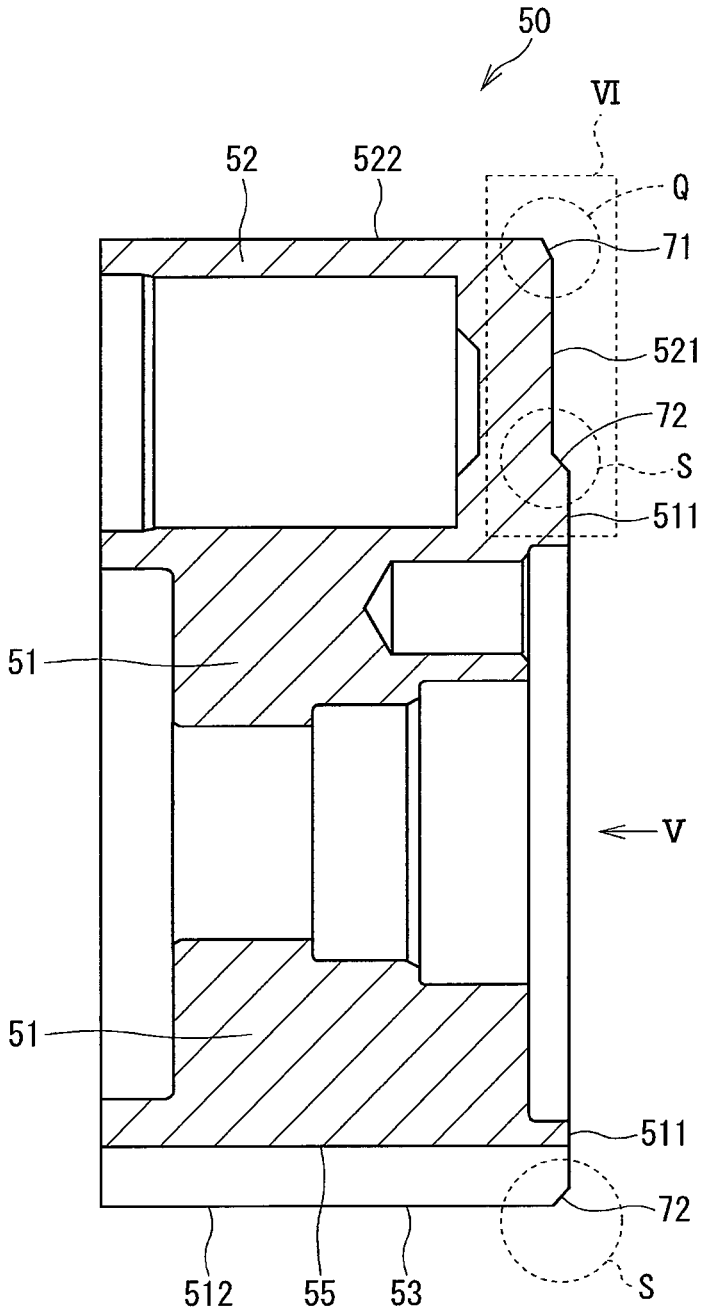
FIG. 4 is a sectional view illustrating a vane rotor of the valve timing control apparatus of the first embodiment.
Figure 5:
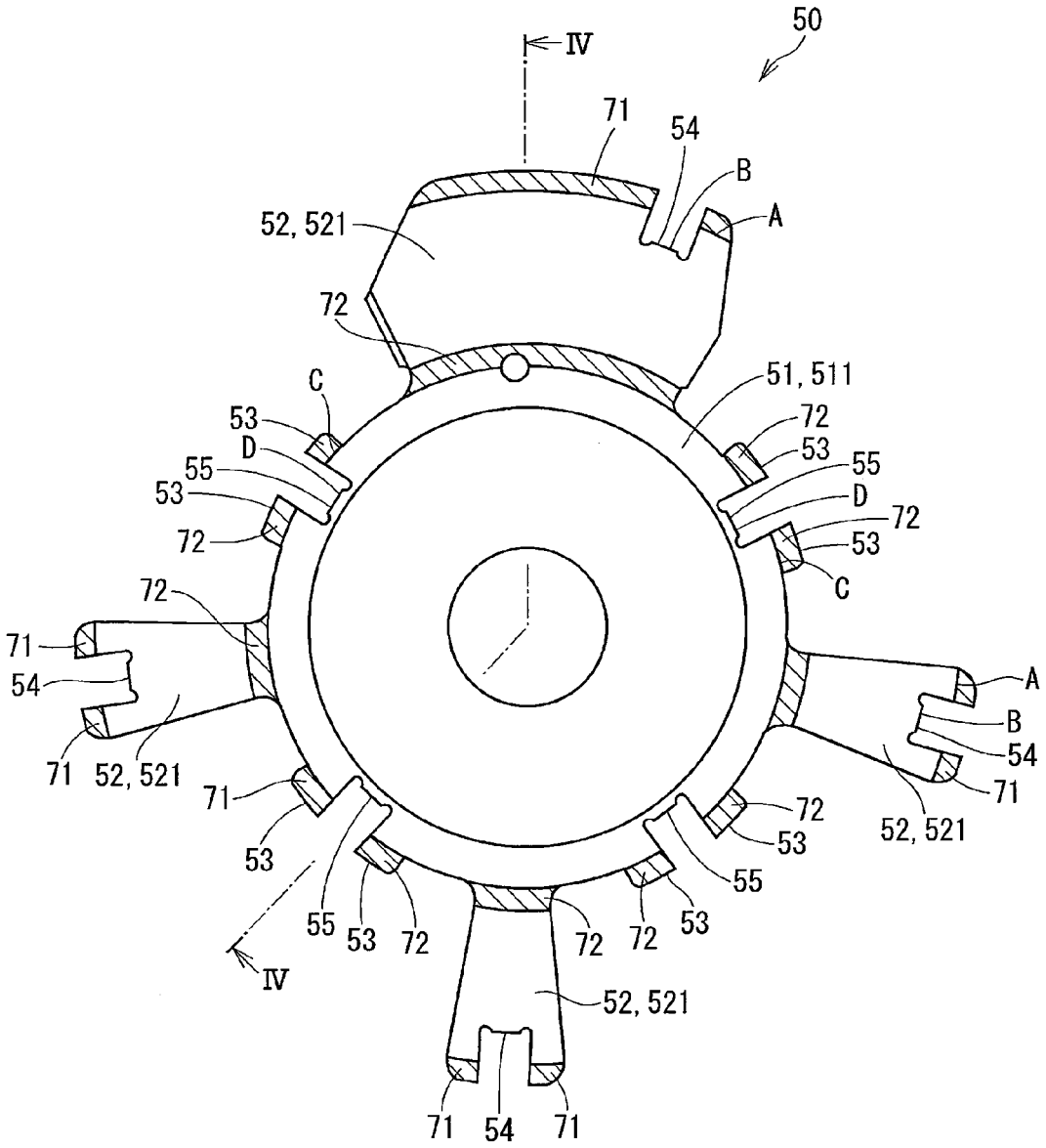
FIG. 5 is a side view seen in a V direction of FIG. 4.

FIG. 4 and FIG. 5 show only the vane rotor 50. In FIG. 5, the hatched portion represents the formation area of the chamfer part 71, 72, e.g., the first chamfer part 71 and the second chamfer part 72, on the vane rotor 50 for explanation.

The first chamfer part 71 is formed on the outer side of the axial end surface 521 of the vane 52 in the radial direction. The first chamfer part 71 connects the axial end surface 521 of the vane 52 and the radially outer surface 522 of the vane 52 with each other, and extends in the circumferential direction. The first chamfer part 71 has a shape of a taper or a curved surface, or may be constructed by a combination of a taper and a curved surface.

The second chamfer part 72 is formed on the outer side of the axial end surface 511 of the rotor 51 in the radial direction. In other words, the second chamfer part 72 is formed on the projection part 53 of the rotor 51. The second chamfer part 72 connects the axial end surface 511 of the rotor 51 and the radially outer surface 512 of the rotor 51 with each other, and extends in the circumferential direction.

Furthermore, the second chamfer part 72 is formed in all the circumference of the radially outer edge of the rotor 51 which is projected toward the camshaft in the axial direction as the axial end surface 521 of the vane 52. The second chamfer part 72 is provided at a connection between the vane 52 and the rotor 51. Specifically, the second chamfer part 72 connects the axial end surface 511 of the rotor 51 to the axial end surface 521 of the vane 52, and extends in the circumferential direction. The second chamfer part 72 has a shape of a taper or a curved surface, or may be constructed by a combination of a taper and a curved surface.

The chamfer part 71, 72 is formed on the outer side of the seal component 60, 61 in the radial direction. In detail, the first chamfer part 71 is formed so that a radially inner end position A of the first chamfer part 71 is located on an outer side of a radially inner end position B of the seal component 60 which is disposed to the radially outer surface of the vane 52.

The second chamfer part 72 is formed so that a radially inner end position C of the second chamfer part 72 is located on an outer side of a radially inner end position D of the seal component 61 which is disposed to the radially outer surface of the rotor 51.

The seal component 60, 61 can prevent oil from moving between the advance chamber 41 and the retard chamber 42 through a clearance which is defined between the housing 30, the rear plate 20, and the vane rotor 50 by the first chamfer part 71 or the second chamfer part 72.

Figure 6:
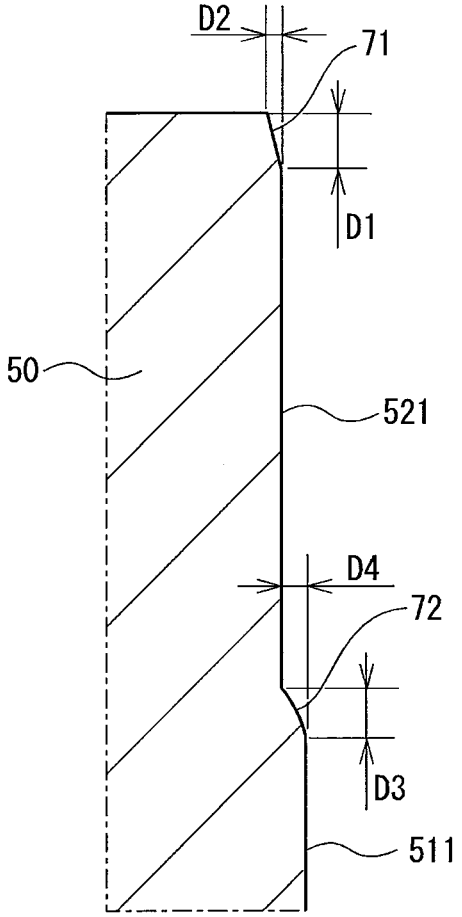
FIG. 6 is an enlarged view of a VI portion of FIG. 4.

FIG. 6 is an enlarged view illustrating a VI portion of FIG. 4. As shown in FIG. 6, the first chamfer part 71 of the vane 52 of the vane rotor 50 is a taper part in which a radial distance (dimension) D1 in the radial direction is larger than an axial distance (dimension) D2 in the axial direction. Moreover, the second chamfer part 72 of the rotor 51 of the vane rotor 50 is a taper part in which a radial distance D3 in the radial direction is larger than an axial distance D4 in the axial direction.

Thereby, in the valve timing control apparatus 1, the surface pressure applied to the vane rotor 50 can be reduced, and the surface pressure applied to the rear plate 20 can be reduced. The sealing property between the housing 30, the rear plate 20, and the vane rotor 50 can be secured. In addition, in the first chamfer part 71 and the second chamfer part 72, the distance D1-D4 should just be not less than tens of micrometers in size so as to reduce the surface (contact) pressure applied to the rear plate 20 and the vane rotor 50.

As shown in FIG. 1, the axial end surface of the rotor 51 adjacent to the camshaft is in contact with an axial end surface 15 of the camshaft 7 adjacent to the rotor. On the other hand, the other axial end surface of the rotor 51 opposite from the camshaft has a recess portion 57 recessed in a cylindrical shape. The bushing 80 having a based cylindrical shape is fitted to the recess portion 57. The bushing 80 is made of, for example, iron, and is press-fitted to the inner wall of the recess portion 57 at a time of manufacturing the valve timing control apparatus 1. The bushing 80 is projected from the recess portion 57, and the radially outer wall of the projected portion of the bushing 80 is slidingly in contact with the inner wall of the central hole 36 defined in the housing 30.

The center bolt 81 passes through a hole of the bushing 80, a hole of the rotor 51, and a hole of the camshaft 7. The center bolt 81 is engaged with a female thread 82 formed at a comparatively deep position in the hole of the camshaft 7. Thereby, the bushing 80, the vane rotor 50, and the cam shaft 7 are fixed with each other.

The cap 83 closes the central hole 36 of the housing 30, and covers the head of the center bolt 81, such that oil is restricted from leaking from the central hole 36 of the housing 30. Thereby, the valve timing control apparatus 1 is constituted as a tightly closed type apparatus from which no oil is leaked from the oil pressure chamber 40 to outside. In addition, a pipe 84 is fixed to the inner wall of the hole of the camshaft 7. An advance oil passage 43 and a retard oil passage 44 are respectively formed on the outer side and the inner side of the pipe 84.

As shown in FIG. 1 and FIG. 2, the vane rotor 50 has plural advance oil passages 45 lead to the advance chamber 41 and plural retard oil passages 46 lead to the retard chamber 42. The advance oil passage 45 and the retard oil passage 46 are respectively connected to the advance oil passage 43 and the retard oil passage 44 defined in the camshaft 7. Oil pumped from an oil pan (not shown) of the vehicle by an oil pump (not shown) flows from an oil pressure control valve (not shown) along the advance oil passage 43 or the retard oil passage 44 of the camshaft 7 and the advance oil passage 45 or the retard oil passage 46 of the vane rotor 50, and is supplied to the advance chamber 41 or the retard chamber 42.

When oil is supplied to the advance chamber 41 from the advance oil passage 43, 45, oil in the retard chamber 42 is discharged through the retard oil passage 44, 46. Thereby, the vane rotor 50 moves in the advance direction relative to the housing 30.

On the other hand, when oil is supplied to the retard chamber 42 from the retard oil passage 44, 46, oil in the advance chamber 41 is discharged through the advance oil passage 43, 45. Thereby, the vane rotor 50 moves in the retard direction relative to the housing 30.

Figure 3:
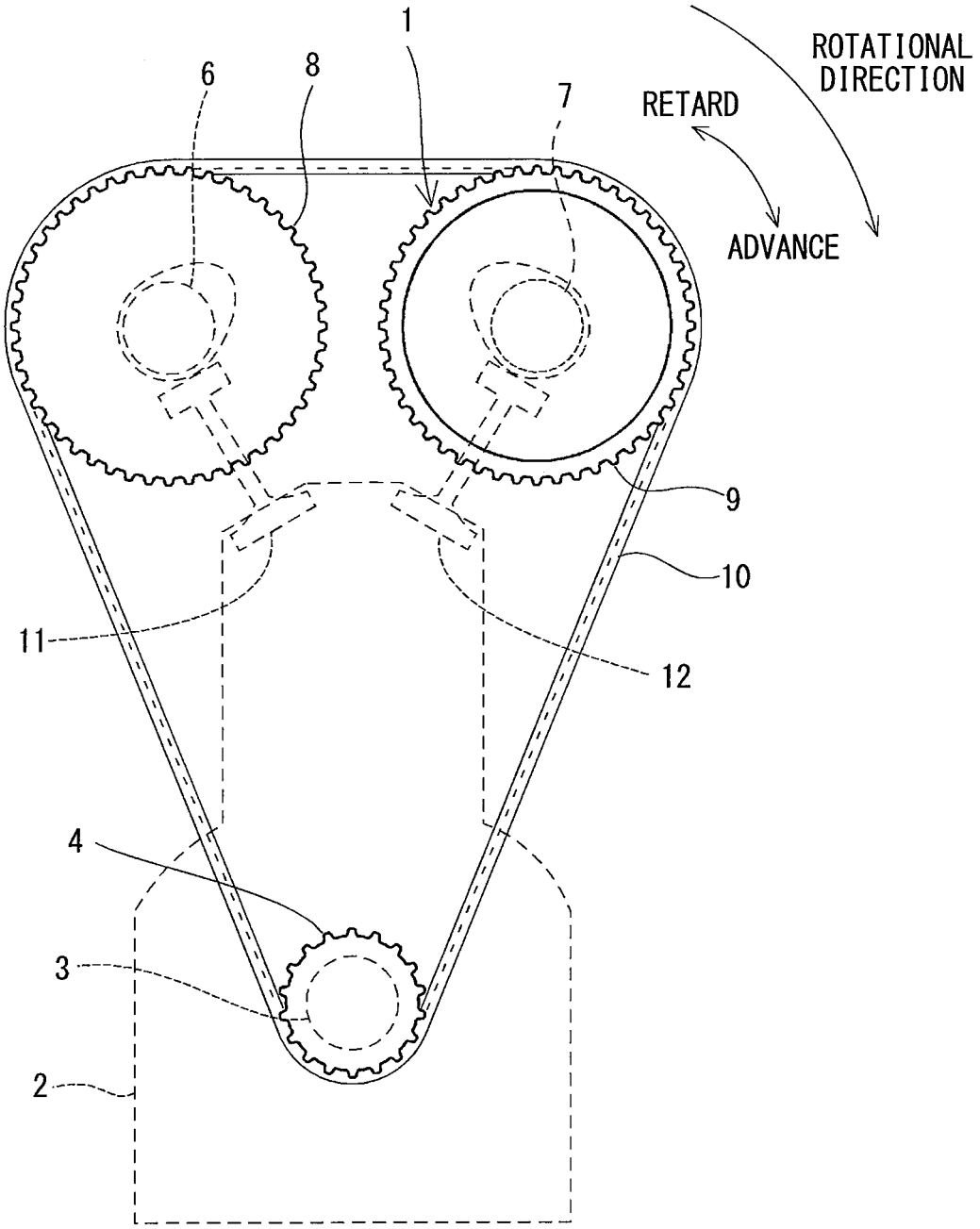
FIG. 3 is schematic view illustrating a power train mechanism having the valve timing control apparatus.

In addition, the arrow directions show in FIG. 2 and FIG. 3 represent the advance direction and the retard direction of the vane rotor 50 relative to the housing 30.

A stopper pin 90 is accommodated in an accommodation hole 91 defined in the vane rotor 50, and is able to have both-way movement in the axial direction. A fitting hole 92 is defined in the front plate 34, and a ring 95 is disposed in the fitting hole 92. The stopper pin 90 is able to fit with the ring 95. When the vane rotor 50 is at the maximum retard position relative to the housing 30, the stopper pin 90 is able to fit to the ring 95 in the fitting hole 92, due to a biasing force of a spring 94. When the stopper pin 90 is fitted to the ring 95, relative rotation between the vane rotor 50 and the housing 30 is regulated.

The fitting hole 92 of the front plate 34 communicates to one of the advance chamber 41 and the retard chamber 42 through the oil passage. A pressure chamber 96 defined on the outer side of the stopper pin 90 in the radial direction communicates to the other of the advance chamber 41 and the retard chamber 42 through the oil passage.

The oil pressure in the fitting hole 92 and the oil pressure in the pressure chamber 96 act in a manner that the stopper pin 90 separates from the ring 95. Therefore, when the sum of the force applied to the stopper pin 90 from the oil pressure of the fitting hole 92 and the force applied to the stopper pin 90 from the oil pressure of the pressure chamber 96 becomes larger than the biasing force of the spring 94, the stopper pin 90 moves out of the ring 95.

Operation of the valve timing control apparatus 1 is explained.

(Engine Start Time)

At a time of starting the engine, the phase of the vane rotor 50 is controlled to the maximum retard position shown in FIG. 2. That is, oil pumped from the oil pan of the vehicle by the oil pump is supplied to the retard chamber 42 through the retard oil passage 46 from the oil pressure control valve. Until oil is fully supplied to the retard chamber 42, the stopper pin 90 maintains to fit with the ring 95.

After the engine is started, when oil is fully supplied to the fitting hole 92 or the pressure chamber 96 from the retard chamber 42, the stopper pin 90 separates from the ring 95. Thereby, the rotation of the vane rotor 50 relative to the housing 30 becomes possible.

(Advance Operation)

When the valve timing control apparatus 1 carries out an advance operation, oil pumped by the oil pump passes along the advance oil passage 45 from the oil pressure control valve, and is supplied to the advance chamber 41. On the other hand, oil of the retard chamber 42 is discharged to the oil pan through the retard oil passage 46. Thereby, the oil pressure of the advance chamber 41 acts on the vane 52, and the vane rotor 50 moves in the advance direction relative to the housing 30.

(Retard Operation)

When the valve timing control apparatus 1 carries out a retard operation, oil pumped by the oil pump passes along the retard oil passage 46 from the oil pressure control valve, and is supplied to the retard chamber 42. On the other hand, oil of the advance chamber 41 is discharged to the oil pan through the advance oil passage 45. Thereby, the oil pressure of the retard chamber 42 acts on the vane 52, and the vane rotor 50 moves in the retard direction relative to the housing 30.

A comparative example is described. Generally, when a valve timing control apparatus is a tightly-closed type apparatus, a space between the cap and the bushing is also filled with oil. Thereby, the cap and the bushing receive pressure of oil staying between the cap and the bushing. Therefore, the sum of "the pressure receive area of the bushing" and "the pressure receive area of the axial end surface of the vane rotor not opposing the camshaft" is larger than "the pressure receive area of the vane rotor opposing the camshaft" by the cross-section area of the camshaft. Thus, the housing and the rear plate are slightly moved away from the camshaft relative to the vane rotor and the camshaft. As a result, load is applied from the rear plate to the axial end surface of the vane rotor adjacent to the camshaft.

Furthermore, at a low temperature time (see FIG. 7), the radially outer side of the vane rotor is distorted toward the camshaft when the bushing is press-fitted to the recess portion defined in the vane rotor. In this case, the radially outer side of the vane rotor is in contact with the rear plate.

In contrast, at a high temperature time (see FIG. 8), the radially outer side of the vane rotor is distorted away from the camshaft by the axial tension of the center bolt and the reaction force of the camshaft. In this case, the radially inner side of the vane rotor is in contact with the rear plate.

As a result, at a low temperature time, when the radially outer side of the vane rotor is distorted toward the camshaft, the contact pressure applied from the rear plate to the radially outer side of the axial end surface of the vane rotor becomes large.

At a high temperature time, when the radially outer side of the vane rotor is distorted away from the camshaft, the contact pressure applied from the rear plate to the radially inner side of the axial end surface of the vane rotor becomes large.

In these cases, if the radially outer side or the radially inner side of the axial end surface of the vane rotor is damaged or broken, the valve timing control apparatus may have abnormal operation.

In contrast, according to the first embodiment, the valve timing control apparatus 1 has the first chamfer part 71. The state of the vane rotor 50 at a low temperature is explained with reference to FIG. 7, and the state of the vane rotor 50 at a high temperature is explained with reference to FIG. 8.

Figure 7:
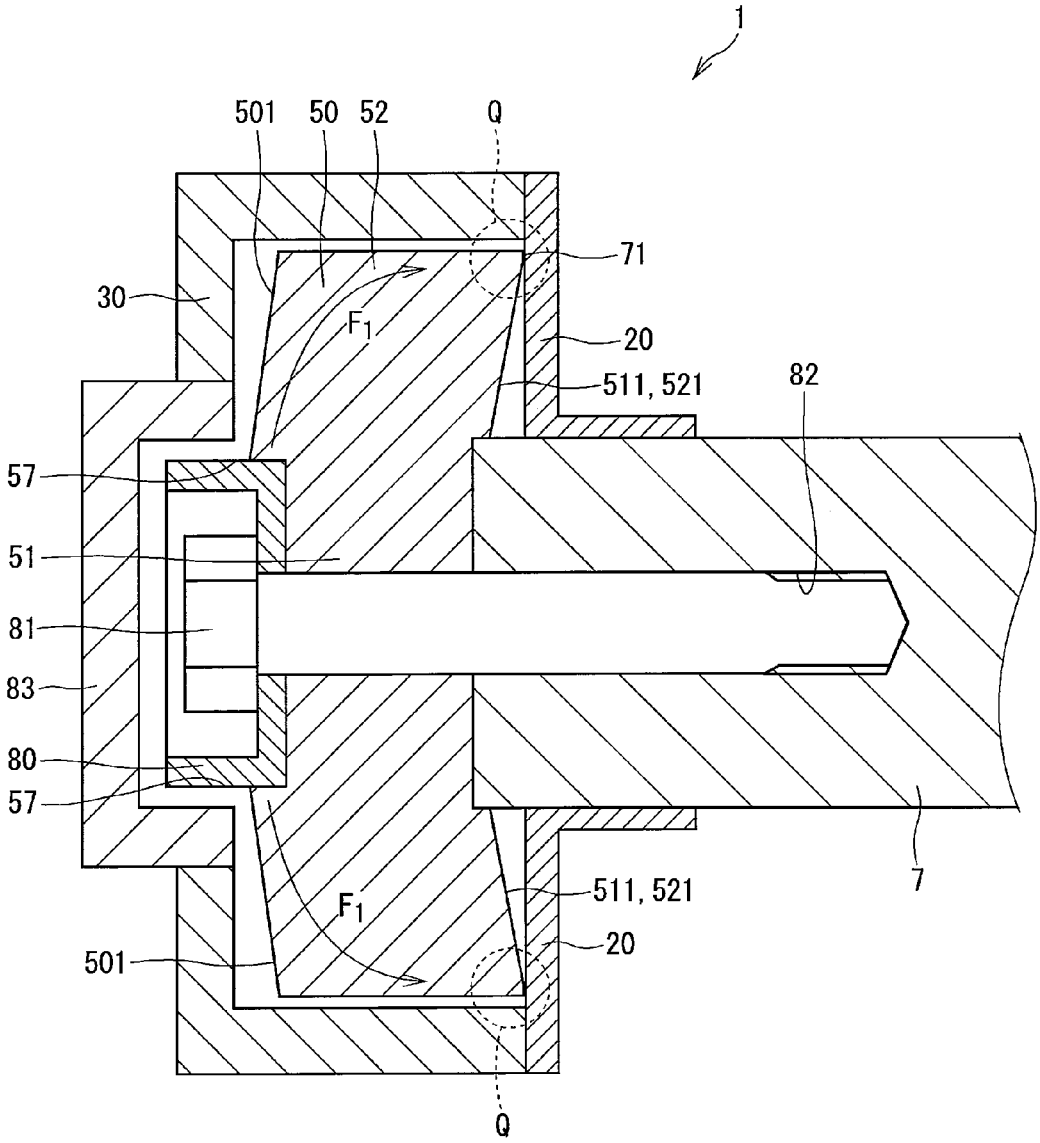
FIG. 7 is a schematic explanatory view illustrating the valve timing control apparatus at a low temperature time.
Figure 8:
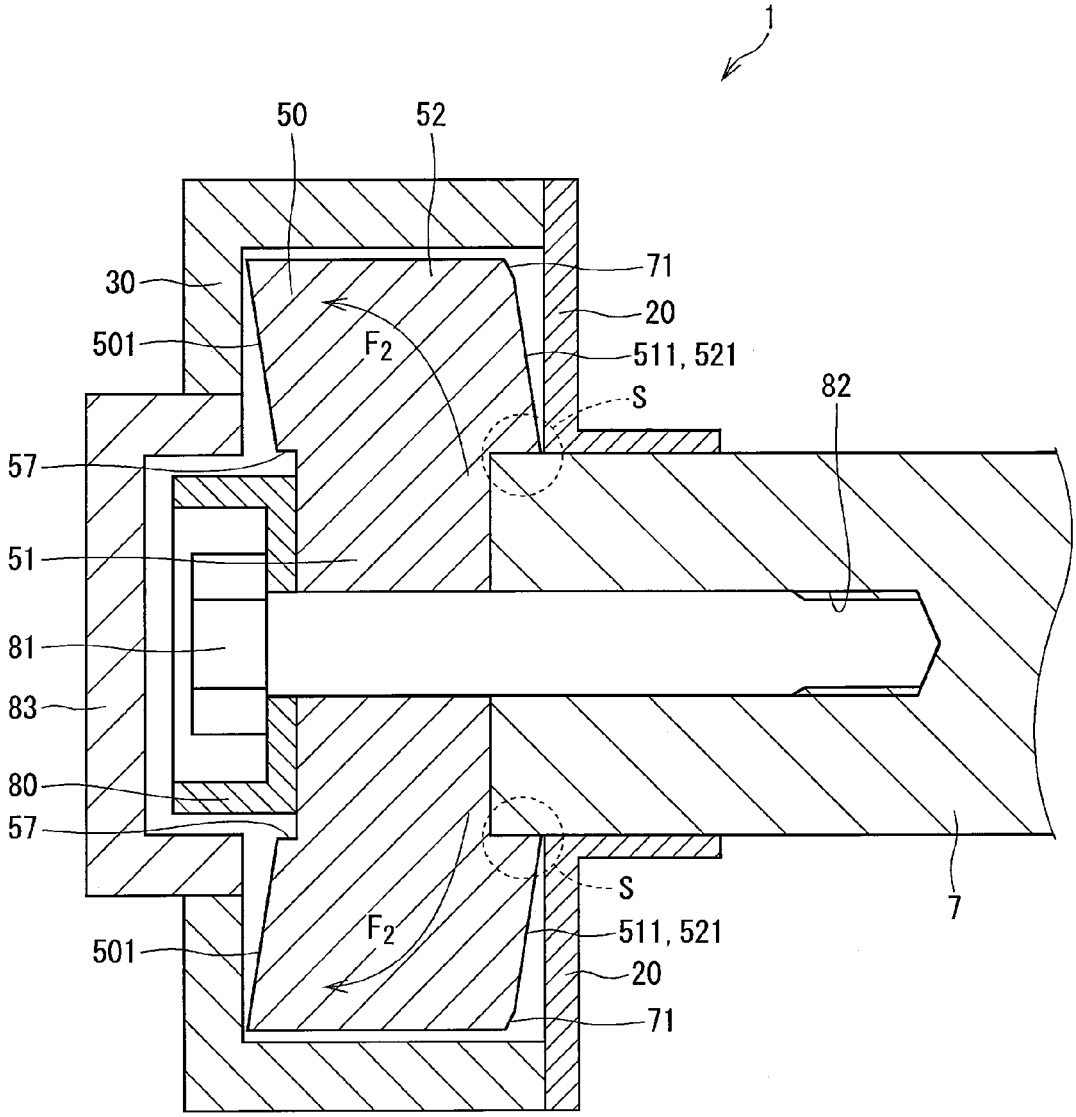
FIG. 8 is a schematic explanatory view illustrating the valve timing control apparatus at a high temperature time.

As shown in FIG. 7 and FIG. 8, in the valve timing control apparatus 1, when oil pressure is supplied to the oil pressure chamber 40, a space between the cap 83 and the bushing 80 is also filled with oil. Therefore, the cap 83 and the bushing 80 receive oil pressure from the oil between the cap 83 and the bushing 80. Moreover, an axial end surface 501 of the vane rotor 50 not facing the camshaft and the inner wall of the housing 30 which faces the axial end surface 501 receive oil pressure from the oil between the axial end surface 501 and the housing 30.

On the other hand, the axial end surface 511, 521 of the vane rotor 50 facing the rear plate and the inner wall of the rear plate 20 which faces the axial end surface 511, 521 receive oil pressure from the oil between the axial end surface 511, 521 and the rear plate 20. At this time, the sum of the pressure receive area of the axial end surface 501 of the vane rotor 50 and the pressure receive area of the bushing 80 is larger than the pressure receive area of the axial end surface 511, 521 of the vane rotor 50, by the cross-sectional area of the camshaft 7.

Therefore, the housing 30 and the rear plate 20 are moved away from the camshaft relative to the vane rotor 50 and the camshaft 7. Thus, at the operation time in which the oil pressure is supplied to the oil pressure chamber 40, a load is applied to the axial end surface 511, 521 of the vane rotor 50 from the rear plate 20, as characteristics of the valve timing control apparatus 1.

As shown in the arrow direction F1 of FIG. 7, in case where the valve timing control apparatus 1 is in a low temperature situation, when the bushing 80 is press-fitted to the recess portion 57 of the vane rotor 50 at a time of assembling the valve timing control apparatus 1, the recess portion 57 of the vane rotor 50 is pressurized outward in the radial direction. As a result, the radially outer side of the vane rotor 50 is distorted toward the camshaft. In this case, the radially outer side of the vane rotor 50 is in contact with the rear plate. Therefore, when the valve timing control apparatus 1 is in a low temperature situation, the radially outer side of the axial end surface 521 of the vane rotor 50 is exposed to a high pressure condition.

Figure 10:
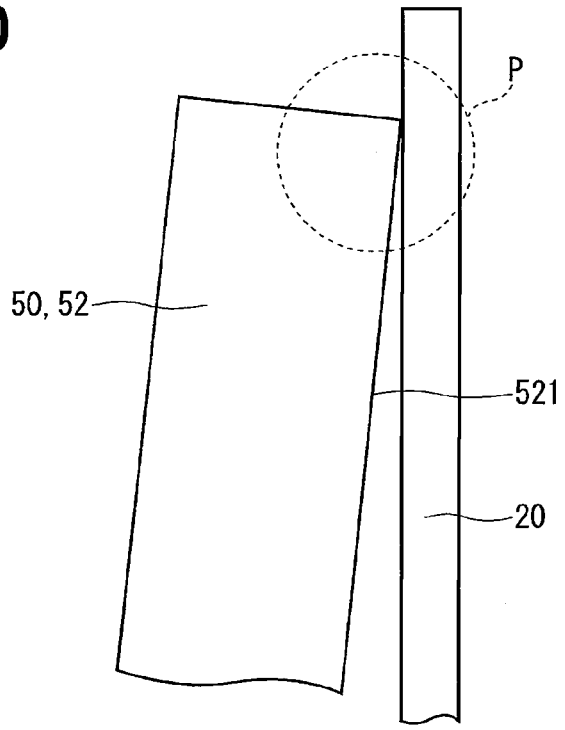
FIG. 10 is a schematic explanatory view illustrating a vane rotor of a rear plate of a comparative example.

Here, FIG. 10 represents a comparative example relative to the valve timing control apparatus 1. In the comparative example, the radially outer side of an axial end surface of a vane rotor adjacent to a rear plate is not chamfered (see a right-angled corner in an area P of FIG. 10). Therefore, the contact pressure applied to the right-angled corner of the vane rotor 50 becomes high. If a break arises at the right-angled corner, oil comes to flow between the advance chamber 41 and the retard chamber 42, and the valve timing control apparatus 1 may have abnormal operation.

Figure 9:
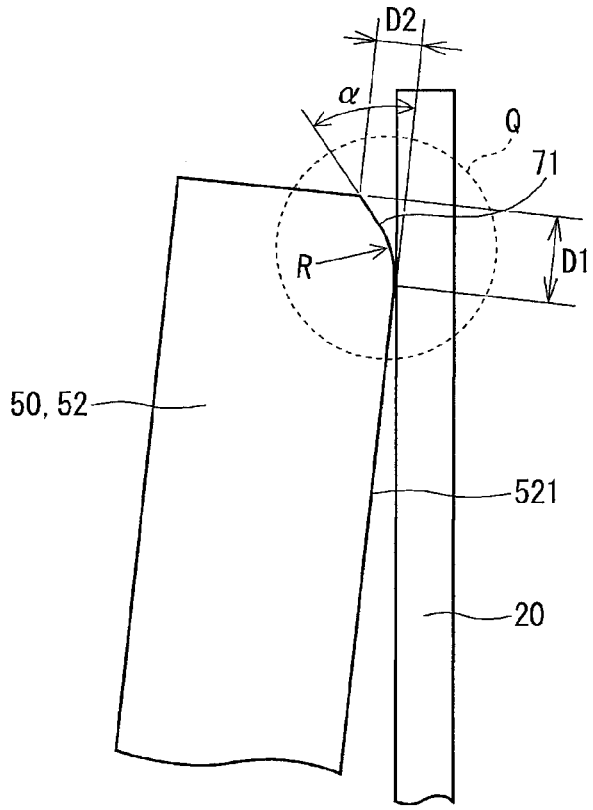
FIG. 9 is a schematic explanatory view illustrating the vane rotor and a rear plate of the valve timing control apparatus of the first embodiment.

In contrast, as shown in FIG. 9, the valve timing control apparatus 1 of this embodiment has the first chamfer part 71 on the radially outer side of the axial end surface 521 of the vane 52 of the vane rotor 50. The first chamfer part 71 is constructed by a combination of a taper angle a and a curved surface R. Moreover, the first chamfer part 71 is formed such that the radial distance D1 in the radial direction is larger than the axial distance D2 in the axial direction, at the taper part.

Thereby, the contact pressure applied to the radially outer side of the axial end surface 521 of the vane 52 is reduced in an area Q of FIG. 9. Therefore, the axial end surface 521 of the vane rotor 50 can be restricted from being damaged. Furthermore, it is possible to secure the sealing property between the housing 30, the rear plate 20, and the vane rotor 50. Thus, reliability can be improved in operation of the valve timing control apparatus 1.

In case where the valve timing control apparatus 1 is in a high temperature state, as shown in FIG. 8, aluminum which forms the vane rotor 50 has a coefficient of linear expansion which is larger than a coefficient of linear expansion of iron which forms the bushing 80. Therefore, when the bushing 80 is press-fitted to the recess portion 57 of the vane rotor 50, the force of press-fitting the bushing 80 does not act on the recess portion 57 of the vane rotor 50. In this case, as shown in the arrow direction F2 of FIG. 8, the vane rotor 50 receives the axial tension generated by tightening the center bolt 81 to the female thread 82 of the camshaft 7 and the reaction force of the end surface of the camshaft. Thereby, the radially outer side of the vane rotor 50 is distorted away from the camshaft. Therefore, the radially inner part S of the vane rotor 50 is in contact with the rear plate 20. Thus, when the valve timing control apparatus 1 is in a high temperature state, the axial end surface 511 of the vane rotor 50 is exposed to a high pressure condition.

Furthermore, as shown in FIGS. 4 to 6, the valve timing control apparatus 1 of this embodiment has the second chamfer part 72 on the radially outer side of the axial end surface 511 of the rotor 51 of the vane rotor 50. The second chamfer part 72 is also shaped in a combination of a taper angle and a curved surface. Moreover, as shown in FIG. 6, the radial distance D3 in the radial direction is larger than the axial distance D4 in the axial direction, at the second chamfer part 72.

Therefore, the contact pressure applied to the radially outer side of the axial end surface 511 of the rotor 51 is reduced. The axial end surface 511 of the rotor 51 is restricted from being damaged. Furthermore, it is possible to secure the seal property between the housing 30, the rear plate 20, and the vane rotor 50. Thus, the reliability can be improved in the operation of the valve timing control apparatus 1.

According to the first embodiment, the valve timing control apparatus 1 has the first chamfer part 71 on the radially outer side of the axial end surface 521 of the vane 52. In case where a load is impressed from the rear plate 20 to the vane rotor 50, the contact pressure applied on the radially outer part Q of the vane 52 is reduced. Therefore, the axial end surface 521 adjacent to the rear plate can be restricted from being damaged.

According to the first embodiment, the valve timing control apparatus 1 has the second chamfer part 72 on the radially outer side of the axial end surface 511 of the rotor 51. In case where a load is impressed from the rear plate 20 to the vane rotor 50, the contact pressure applied on the radially outer part S of the rotor 51 is reduced. Therefore, the axial end surface 511 adjacent to the rear plate can be restricted from being damaged.

According to the first embodiment, the first chamfer part 71 is located on the radially outer side as the radially inner edge B of the seal component 60. Oil stays between the housing 30 and the rear plate 20, and the first chamfer part 71. The seal component 60 prevents the oil from moving between the advance chamber 41 and the retard chamber 42. Therefore, the reliability can be improved in the operation of the valve timing control apparatus 1.

According to the first embodiment, the second chamfer part 72 is located on the radially outer side as the radially inner edge D of the seal component 61. Oil stays between the housing 30 and the rear plate 20, and the second chamfer part 72. The seal component 61 prevents the oil from moving between the advance chamber 41 and the retard chamber 42.

According to the first embodiment, the axial end surface 511 of the rotor 51 has the second chamfer part 72, and is formed to be projected in the axial direction as the axial end surface 521 of the vane 52. The second chamfer part 72 is easily formed by cutting and shaving while rotating the vane rotor 50 by lathe processing.

According to the first embodiment, each of the first chamfer part 71 and the second chamfer part 72 has a shape of at least one of a taper and a curved surface. Thereby, the field pressure applied on the first chamfer part 71 and the second chamfer part 72 from the rear plate 20 can be reduced.

According to the first embodiment, the valve timing control apparatus 1 includes the bushing 80, the center bolt 81, and the cap 83 so as to tightly close the structure. The first chamfer part 71 and the second chamfer part 72 are formed at positions opposite from the cap 83 through the vane rotor 50.

Therefore, in case where the load applied on the vane rotor 50 from the rear plate 20 is large due to the pressure of oil between the bushing 80 and the cap 83, the first chamfer part 71 and the second chamfer part 72 can reduce the pressure applied on the vane rotor 50.

(Second Embodiment)

A second embodiment is described with reference to FIG. 11 and FIG. 12.

Figure 11:
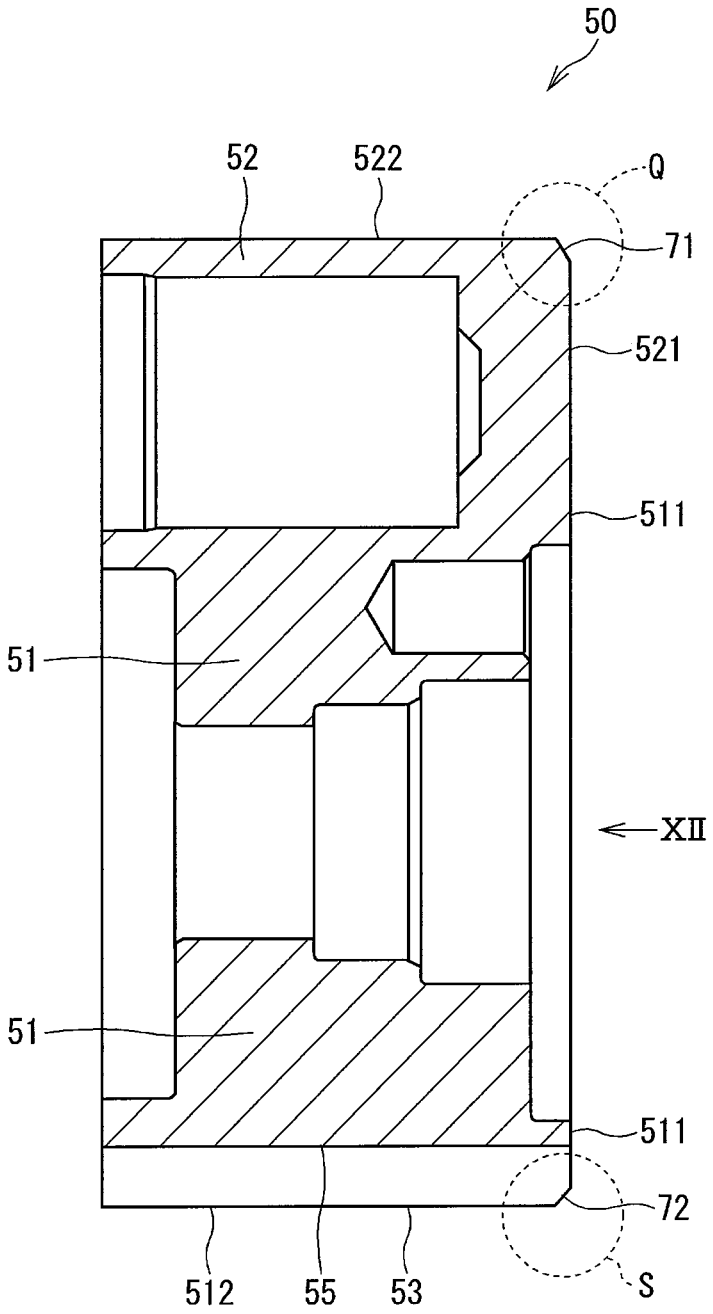
FIG. 11 is a sectional view illustrating a vane rotor of a valve timing control apparatus according to a second embodiment.
Figure 12:
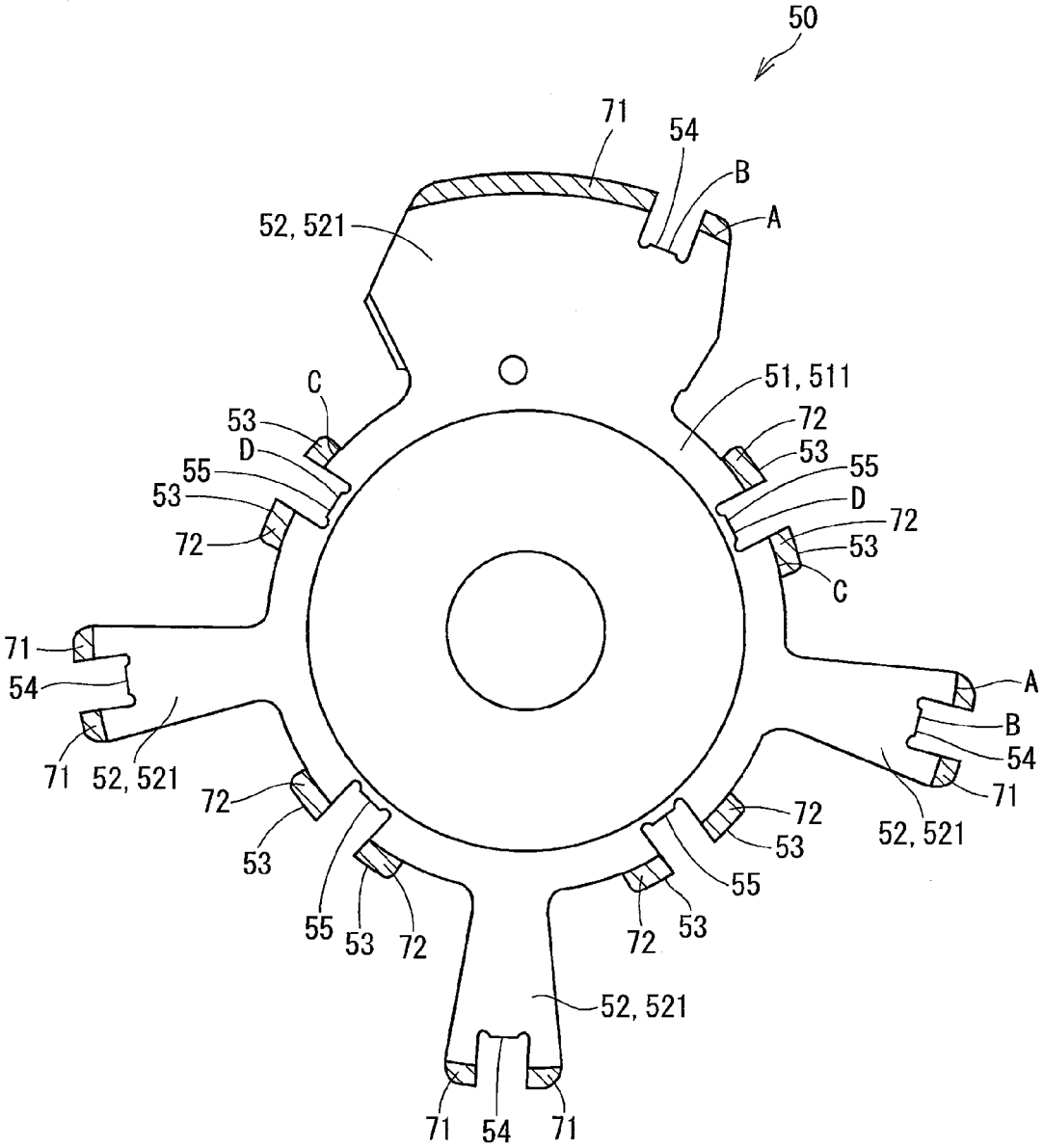
FIG. 12 is a side view seen in a XII direction of FIG. 11.

In the second embodiment, as shown in FIG. 11, the axial end surface 511 of the rotor 51 and the axial end surface 521 of the vane 52 are on the same plane. Therefore, as shown in FIG. 12, the second chamfer part 72 is formed only on the projection part 53 of the rotor 51. In the second embodiment, the same action and effect can be obtained as the first embodiment.

(Other Embodiment)

The present disclosure may be applied to the exhaust valve instead of the intake valve.

The vane rotor may have only one of the first chamfer part and the second chamfer part, not both of the first chamfer part and the second chamfer part.

The advantages of the first chamfer part and the second chamfer part are not limited to the above situation where the environmental temperature is high or low. For example, the advantages are effective when the pressure applied to the radially outer side of a vane rotor is increased by an axial gap between the vane rotor and the housing.

Such changes and modifications are to be understood as being within the scope of the present disclosure as defined by the appended claims.

What is claimed is:

1. A valve timing control apparatus that controls a rotation phase between a driving shaft and a driven shaft of an internal combustion engine so as to control opening-and-closing timing of an intake valve or an exhaust valve which is driven to open or close by the driven shaft, the valve timing control apparatus comprising:

a rear plate rotated by a driving force transmitted from the driving shaft;

a housing fixed to the rear plate to be opposite from the driven shaft through the rear plate in a thickness direction of the rear plate, an oil pressure chamber being defined inside the housing;

a vane rotor which is able to rotate relative to the housing, the vane rotor having a rotor having a cylindrical shape and coaxially fixed to the driven shaft, and a vane extending from the rotor outward in a radial direction to divide the oil pressure chamber of the housing into an advance chamber and a retard chamber, the vane having an axial end surface adjacent to the rear plate and a radially outer surface;

a first chamfer part defined at a connection between the axial end surface and the radially outer surface of the vane so as to reduce a contact pressure applied from the rear plate to the vane, the first chamfer part comprising a taper part in which a radial distance in the radial direction is larger than an axial distance in the axial direction; and a second chamfer part defined at a connection between an axial end surface of the rotor and a radially outer surface of the rotor so as to reduce a contact pressure applied from the rear plate to the rotor.

2. The valve timing control apparatus according to claim 1, further comprising:

a first seal component arranged at the radially outer surface of the vane so as to restrict oil from moving between the advance chamber and the retard chamber, wherein the first chamfer part is located on an outer side of a radially inner end of the first seal component in the radial direction.

3. The valve timing control apparatus according to claim 1, further comprising:

a second seal component arranged at the radially outer surface of the rotor so as to restrict oil from moving between the advance chamber and the retard chamber, wherein the second chamfer part is located on an outer side of a radially inner end of the second seal component in the radial direction.

4. The valve timing control apparatus according to claim 1, wherein the axial end surface of the rotor is projected in an axial direction as the axial end surface of the vane.

5. The valve timing control apparatus according to claim 1, wherein the first chamfer part has a shape of at least one of a taper and a curved surface, and the second chamfer part has a shape of at least one of a taper and a curved surface.

6. The valve timing control apparatus according to claim 1, further comprising:

a bushing having a based cylindrical shape, the bushing being fitted to a recess portion defined at a center of the vane rotor;

a center bolt which fixes the bushing, the vane rotor, and the driven shaft with each other; and a cap which closes a central hole of the housing, wherein the first chamfer part and the second chamfer part are located opposite from the cap through the vane rotor.

7. The valve timing control apparatus according to claim 1, wherein the second chamfer part comprises a taper part in which a radial distance in the radial direction is larger than an axial distance in the axial direction.

8. The valve timing control apparatus according to claim 1, wherein the vane rotor has a coefficient of linear expansion which is larger than a coefficient of linear expansion of the bushing.

9. The valve timing control apparatus according to claim 1, wherein the vane rotor is made of aluminum, and the bushing is made of iron.

10. The valve timing control apparatus according to claim 1, wherein the first chamfer part comprises a curved surface.

11. The valve timing control apparatus according to claim 1, wherein the second chamfer part comprises a curved surface.

* * * * *